US008991654B2

(12) United States Patent
MacIntyre, III

(10) Patent No.: US 8,991,654 B2
(45) Date of Patent: Mar. 31, 2015

(54) TENSION STRAP BASED AEROSOL DELIVERY SYSTEM

(71) Applicant: Neil Ross MacIntyre, III, Wrightsville Beach, NC (US)

(72) Inventor: Neil Ross MacIntyre, III, Wrightsville Beach, NC (US)

(73) Assignee: Solotan LLC, Wrightsville Beach, NC (US)

( * ) Notice: Subject to any disclaimer, the term of this patent is extended or adjusted under 35 U.S.C. 154(b) by 100 days.

(21) Appl. No.: 13/896,290

(22) Filed: May 16, 2013

(65) Prior Publication Data

US 2014/0339264 A1 Nov. 20, 2014

Related U.S. Application Data

(60) Provisional application No. 61/647,510, filed on May 16, 2012.

(51) Int. Cl.
*B67D 7/06* (2010.01)
*B65D 83/20* (2006.01)

(52) U.S. Cl.
CPC ..... *B65D 83/20* (2013.01)
USPC ..... 222/175; 222/192; 222/467; 222/469; 222/1; 239/154; 239/529; 224/148.6

(58) Field of Classification Search
CPC ..... A45F 2200/05; A45F 2200/0583; B05B 7/1413; B05B 7/2402; B05B 7/241; B05B 9/08; B05B 9/0805; B05B 11/00; B05B 12/002; B05B 13/00; B05B 15/00; B05B 15/06; B05B 15/061; B05B 15/064; B65D 83/20; B65D 83/202
USPC ..... 222/175, 192, 323, 402.1, 467, 469, 1; 224/148.6, 917; 239/152–154, 529
See application file for complete search history.

(56) References Cited

U.S. PATENT DOCUMENTS

| | | | | | |
|---|---|---|---|---|---|
| 3,277,855 | A * | 10/1966 | Roing | 112/413 |
| 4,838,466 | A * | 6/1989 | Holmstrom | 224/250 |
| 4,909,505 | A * | 3/1990 | Tee | 482/129 |
| 5,449,151 | A * | 9/1995 | Johnson | 267/71 |
| D368,501 | S * | 4/1996 | Woodruff | D21/692 |
| 5,961,003 | A * | 10/1999 | Coryell | 222/175 |
| 7,992,525 | B1 * | 8/2011 | Fisher | 119/860 |
| 2005/0085350 | A1 * | 4/2005 | Shen | 482/91 |

* cited by examiner

*Primary Examiner* — Kevin P Shaver
*Assistant Examiner* — Nicholas J Weiss
(74) *Attorney, Agent, or Firm* — Coats & Bennett, PLLC

(57) ABSTRACT

A method of spraying a posterior portion of a human person includes disposing an aerosol container in an aerosol container receiving bay of a strap-based aerosol delivery assembly. The aerosol container has product therein and a dispensing button. The aerosol delivery assembly includes: the aerosol container receiving bay having a fixed length perimeter; left and right grip sections disposed on opposing lateral sides of the aerosol container receiving bay. The method includes disposing the aerosol delivery assembly such that the aerosol container receiving bay is disposed posteriorly relative to the person, and while so positioned, dispensing product from the aerosol container toward the person's posterior by pulling the left and right grip sections away from each other, so that a vertical height of the aerosol container receiving bay is decreased to thereby depress the dispensing button of the aerosol container. Related assemblies are also disclosed.

15 Claims, 1 Drawing Sheet

TENSION STRAP BASED AEROSOL DELIVERY SYSTEM

This application claims the benefit of U.S. Provisional Application No. 61/647,510, filed 16 May 2012, the entire disclosure of which is incorporated herein by reference.

BACKGROUND OF THE INVENTION

The present invention relates to aerosol spray methods and apparatus and more particularly, to a tension strap-based aerosol delivery system.

Aerosolized fluids, such as sunscreens, bug sprays, or the like, are often quite difficult to apply to one's upper and lower back. A user either needs the assistance of another, or tries to bend and flex to apply the fluid at a less than optimal angle.

Conventional systems that try to solve this problem are often bulky and non-portable systems. Conventional rod-based systems are bulky and are difficult to transport.

As can be seen, there is a need for an improved system for delivering aerosolized fluids to a person's back.

DETAILED DESCRIPTION OF THE INVENTION

Figures 1, 2, 3, 4, 5:
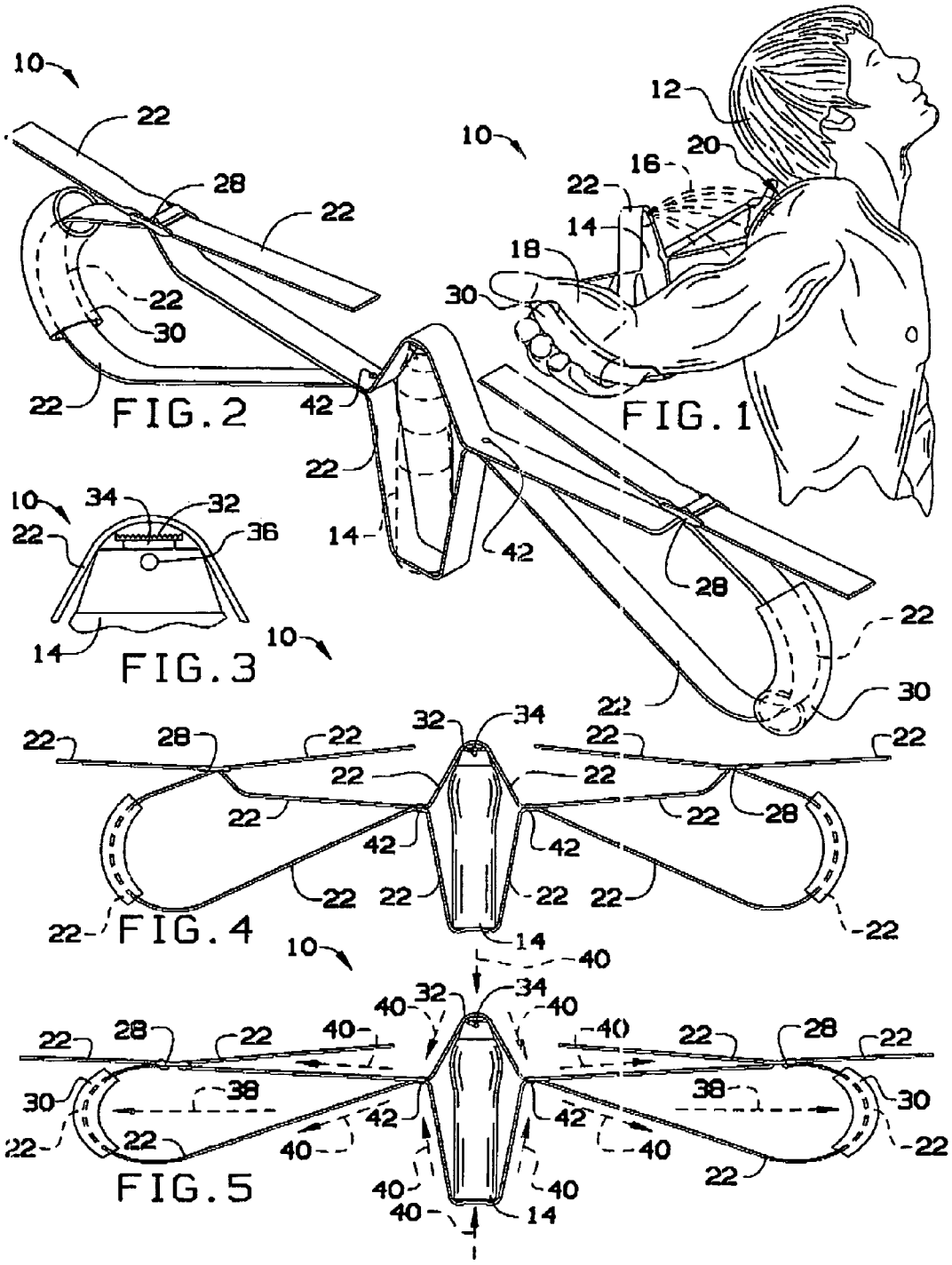
FIG. 1 is a perspective view of a strap-based delivery system, in use, according to an exemplary embodiment of the present invention.
FIG. 2 is a perspective view of the strap-based delivery system of FIG. 1.
FIG. 3 is a detailed front view of the strap-based delivery system of FIG. 1.
FIG. 4 is a front view of the strap-based delivery system of FIG. 1.
FIG. 5 is a front view of the strap-based delivery system of FIG. 1, showing the forces generated during use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a tension strap-based aerosol delivery system. The delivery system of the present invention can easily and uniformly apply aerosolized based product to a user's back without the assistance of another. The user can simply pull on tension straps to depress a trigger on an aerosol container to apply product where desired.

Referring now to FIGS. 1 through 5, a strap-based aerosol delivery system 10 (also referred to as delivery system 10) may be employed by a user 12 to deliver product 16 from an aerosol container nozzle 36 of an aerosol container 14 to their back region 20. The delivery system 10 includes a strap 22 that may be joined together to form an aerosol container placement region. The strap 22 may be joined together by various means, such as rivets 42. The aerosol container 14 may fit inside the aerosol container placement region. The length of the strap 22 may be adjustable with adjustment buckles 28. Soft handles 30 may optionally be disposed on each end of the strap 22 to permit the users hands 18 a soft surface to grasp during use. In some embodiments, the user may simply operate the delivery system 10 by grasping the strap 22 directly.

The aerosol container 14 may be contained within the aerosol container placement region by, for example, hook and loop fastener 32 (such as Velcro®) disposed on an aerosol container button 34 of the aerosol container 14and also on the strap 22. Other means for securing the container 14 within the placement region may be used, such as one or more additional straps connected across the placement region, for example.

Referring to FIGS. 1 and 5, when the user 12 pulls on the handles 30 in the direction indicated by arrows 38, forces 40 are achieved throughout the delivery system 10. The forces 40 cause the aerosol container placement region to want to become more linear, causing the strap 22 to depress the button 34, thereby delivering product 16.

The strap 22 may be about 3 feet long, from handle to handle, but may be adjustable via the adjustment buckles 28 (or some other similar adjustment mechanism). The rivets 42 may be disposed to create an aerosol container placement region adapted to hold the aerosol container 14. In some embodiments, an adjustment mechanism may be provided to adjust the size of the aerosol container placement region.

The delivery device 10 of the present invention may be used to deliver sun screen, bug spray, or other aerosolized products. The delivery device 10 may be used to apply product onto difficult to reach places, such as the user's back, back of their legs, buttocks, or the like.

It should be understood, of course, that the foregoing relates to exemplary embodiments of the invention and that modifications may be made without departing from the spirit and scope of the invention as set forth in the following claims.

What is claimed is:

1. A method of spraying a posterior portion of a human person, comprising:

disposing an aerosol container in an aerosol container receiving bay of a strap-based aerosol delivery assembly: the aerosol container having product therein and having a dispensing button operative to dispense the product when depressed;

wherein the aerosol delivery assembly comprises:

the aerosol container receiving bay: the aerosol container receiving bay having a fixed length perimeter;

a left grip section disposed on a second opposite lateral side of the aerosol container receiving bay;

a right grip section disposed on a second opposite lateral side of the aerosol container receiving bay;

thereafter, disposing the aerosol delivery assembly such that the aerosol container receiving bay is disposed posteriorly relative to the person, and while so positioned, dispensing product from the aerosol container toward the person's posterior by pulling the left and right grip sections away from each other, so that a vertical height of the aerosol container receiving bay is decreased to thereby depress the dispensing button of the aerosol container.

2. The method of claim 1, wherein the disposing the aerosol container in the aerosol container receiving bay comprises attaching the aerosol container to the aerosol de1ivery assembly via at least one hook and loop fastener.

3. The method of claim 1, further comprising, prior to the dispensing, adjusting a length at least one of the left grip section and the right grip section.

4. The method of claim 1, wherein the pulling the left and right grip sections away from each other comprises gripping first and second soft handles of the left and right grip sections, respectively.

5. A strap-based aerosol delivery assembly, comprising:

a strap structure forming:

an aerosol container receiving bay; the aerosol container receiving bay having a fixed length perimeter;

a left grip section disposed on a first lateral side of the aerosol container receiving bay;

a right grip section disposed on a second opposite lateral side of the aerosol container receiving bay;

wherein the strap structure is configured such that pulling the left and right grip sections away from each other causes a vertical height of the aerosol container receiving bay to be decreased to thereby depress a dispensing button of an aerosol container when the aerosol container is disposed in the aerosol container receiving bay.

6. The aerosol delivery assembly claim 5:

wherein the strap structure comprises first and second distinct sections of strap material;

further comprising:

a first fastener affixing the first strap section to the second strap section at a boundary between the aerosol container receiving bay and the left grip section;

a second fastener affixing the first strap section to the second strap section at a boundary between the aerosol container receiving bay and the right grip section.

7. The aerosol delivery assembly of claim 5:

wherein the left grip section comprises a first soft handle disposed in spaced relationto the aerosol container receiving bay;

wherein the right grip section comprises a second soft handle disposed in spaced relation to the aerosol container receiving bay.

8. The aerosol delivery assembly of claim 5, wherein the aerosol container receiving bay includes one or more first sections of a hook and loop fastener disposed on an interior thereof.

9. The aerosol delivery assembly of claim 5, wherein the left grip section and the right grip section are both variable in length.

10. The aerosol delivery assembly of claim 9, wherein the left grip section and the right grip section each include a corresponding adjustment buckle.

11. A strap-based aerosol delivery assembly, comprising:

a strap structure forming:

an aerosol container receiving bay: the aerosol container receiving bay having a fixed length perimeter;

a left grip section disposed on a first lateral side of the aerosol container receiving bay;

a right grip section disposed on a second opposite lateral side of the aerosol container receiving bay;

wherein, the strap structure is movable from a containment configuration to a dispensing configuration by pulling the left and right grip sections away from each other, wherein:

in the containment configuration, the aerosol container receiving bay has a first vertical height and the first and second grip sections are separated a first distance;

in the dispensing configuration, the aerosol container receiving bay has a second vertical height less than the first vertical height and the first and second grip sections are separated a second distance larger than the first distance;

wherein the aerosol container receiving bay includes one or more first sections of a hook and loop fastener disposed on an interior thereof.

12. The aerosol delivery assembly of claim 11:

wherein the strap structure comprises first and second distinct sections of strap material;

further comprising:

a first fastener affixing the first strap section to the second strap section at a boundary between the aerosol container receiving bay and the left grip section;

a secod fastener affixing the first strap section to the second strap section at a boundary between the aerosol container receiving bay and the right grip section.

13. The aerosol delivery assembly of claim 11:

wherein the left grip section comprises a first soft handle disposed in spaced relation to the aerosol container receiving bay;

wherein the right grip section comprises a second soft handle disposed in spaced relation to the aerosol container receiving bay.

14. The aerosol delivery assembly of claim 11, wherein the left grip section and the right grip section are both variable in length.

15. The aerosol delivery assembly of claim 14, where in the left grip section and the right grip section each include a corresponding adjustment buckle.

* * * * *